US008805568B2

(12) United States Patent
Maki

(10) Patent No.: US 8,805,568 B2
(45) Date of Patent: Aug. 12, 2014

(54) SEWING MACHINE

(71) Applicant: Ryutaro Maki, Gifu (JP)

(72) Inventor: Ryutaro Maki, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 14/054,161

(22) Filed: Oct. 15, 2013

(65) Prior Publication Data

US 2014/0116309 A1 May 1, 2014

(30) Foreign Application Priority Data

Oct. 31, 2012 (JP) ..... 2012-239705

(51) Int. Cl.
*D05B 19/16* (2006.01)
*D05B 19/12* (2006.01)

(52) U.S. Cl.
CPC ..... *D05B 19/12* (2013.01); *D05B 19/16* (2013.01)
USPC ..... 700/137; 112/470.03

(58) Field of Classification Search
CPC ..... D05B 19/02; D05B 19/12; D05B 19/14; D05B 19/16; G05B 2219/2626; G05B 2219/45195
USPC ..... 112/470.01, 470.03, 470.05; 700/136, 700/137, 138
See application file for complete search history.

(56) References Cited

U.S. PATENT DOCUMENTS 3,966,331 A 6/1976 Inuiya
4,712,497 A 12/1987 Nomura et al.
4,998,489 A 3/1991 Hisatake et al.
6,000,350 A 12/1999 Koike et al.
7,079,917 B2 7/2006 Taguchi et al.
7,373,891 B2 5/2008 Koerner
8,528,491 B2 9/2013 Bentley
2004/0182295 A1 9/2004 Pfeifer
2009/0188413 A1 7/2009 Hirata et al.
2012/0111249 A1 5/2012 Sekine
2012/0210925 A1 8/2012 Koga et al.
2013/0233217 A1 9/2013 Shimizu et al.
2013/0233220 A1 9/2013 Nomura et al.

FOREIGN PATENT DOCUMENTS

JP A-61-247495 11/1986
JP A-2009-172123 8/2009

OTHER PUBLICATIONS

U.S. Appl. No. 13/788,979, filed Mar. 7, 2013 in the name of Yutaka Nomura et al.
Mar. 4, 2014 Office Action issued in U.S. Appl. No. 13/788,979.

*Primary Examiner* — Danny Worrell
(74) *Attorney, Agent, or Firm* — Oliff PLC

(57) ABSTRACT

A sewing machine includes a feed portion, a detection portion configured to detect ultrasonic waves, a processor and a memory configured to store computer-readable instructions. The computer-readable instructions cause the processor to perform processes that includes identifying a first position based on the ultrasonic waves, calculating a first distance based on the first position, causing the feed portion to feed the work cloth in accordance with first data, identifying a second position based on the ultrasonic waves after the feed portion has fed the work cloth in accordance with the first data, calculating as third distance based on the first distance and the second position, calculating a feed efficiency of the feed portion, correcting a fourth distance to a fifth distance based on the feed efficiency, and causing the feed portion to feed the work cloth in accordance with second data for feeding the work cloth over the fifth distance.

4 Claims, 9 Drawing Sheets

SEWING MACHINE

CROSS-REFERENCE TO RELATED APPLICATION

This application claims priority to Japanese Patent Application No. 2012-239705, filed Oct. 31, 2012, the content of which is hereby incorporated herein by reference in its entirety.

BACKGROUND

The present disclosure relates to a sewing machine. More specifically, the present disclosure relates to a sewing machine that is capable of performing sewing up to a set position.

A sewing machine is known that is capable of ceasing operation when sewing has been completed for a length that was set in advance. For example, a sewing machine is known that is provided with is cloth feed pitch data generation device that detects a cloth feed pitch and generates cloth feed pitch data that correspond to the detected cloth teed pitch. The sewing machine calculates an actual length of sewn stitches by adding up the cloth feed pitch data for every stitch and ceases operation when the actual length that has been calculated matches the length that was set in advance.

SUMMARY

The cloth feed pitch data generation device of the sewing machine, does not detect an actual amount of movement of a work cloth as the cloth feed pitch, but instead detects a cloth feed pitch that bas been adjusted and set by a feed adjustment device, based on an angle of inclination and the like of the feed adjustment device. However, the actual amount of movement of the work cloth may not always match the cloth feed pitch that has been set by the feed adjustment device, due to the effects of puckering of the work cloth, loss in the feed amount due to slippage between the work cloth and a feed dog, and the like. In these cases, there is a possibility that the sewing machine will not be able to cease operation accurately at the position where the sewing has been completed for the length that has been set.

Various embodiments of the broad principles derived herein provide a sewing machine that is capable of performing sewing accurately up to a position that has been set.

Various embodiments herein provide a sewing machine that includes a feed portion, a detection portion, a processor and a memory. The feed portion is configured to feed a work cloth in a feed direction. The detection portion is configured to detect ultrasonic waves. The memory is configured to store computer-readable instructions that, when executed by the processor, cause the processor to perform processes that includes identifying a position of an ultrasonic wave transmission source as a first position, based on ultrasonic waves that have been transmitted from the ultrasonic wave transmission source and detected by the detection portion, the ultrasonic wave transmission source being placed on the work cloth, calculating a first distance based on the first position, the first distance being a distance from a reference position to the first position, causing the feed portion to feed the work cloth in accordance with first data, the first data being data for feeding the work cloth over a second distance, the second distance being shorter than the first distance, identifying, after the feed portion has fed the work cloth in accordance with the first data, a position of the ultrasonic wave transmission source as a second position based on the ultrasonic waves that have been transmitted from the ultrasonic wave transmission source and detected by the detection portion, the ultrasonic wave transmission source being placed on the work cloth, the second position being an equivalent of the first position after the work cloth has been fed, calculating a third distance based on the first distance and the second position, the third distance being an actual distance over which the work cloth has been fed, calculating a feed efficiency of the feed portion, based an the second distance and the third distance, the second distance being a distance based on the first data, correcting a fourth distance to as fifth distance, based on the feed efficiency, the fourth distance being a distance that is derived by subtracting the third distance front the first distance, and causing the feed portion to feed the work cloth in accordance with second data, the second data being data for feeding the work cloth over the fifth distance.

BRIEF DESCRIPTION OF THE DRAWINGS

Embodiments will be described below in detail with reference to the accompanying drawings in which.

DETAILED DESCRIPTION

Figure 1:
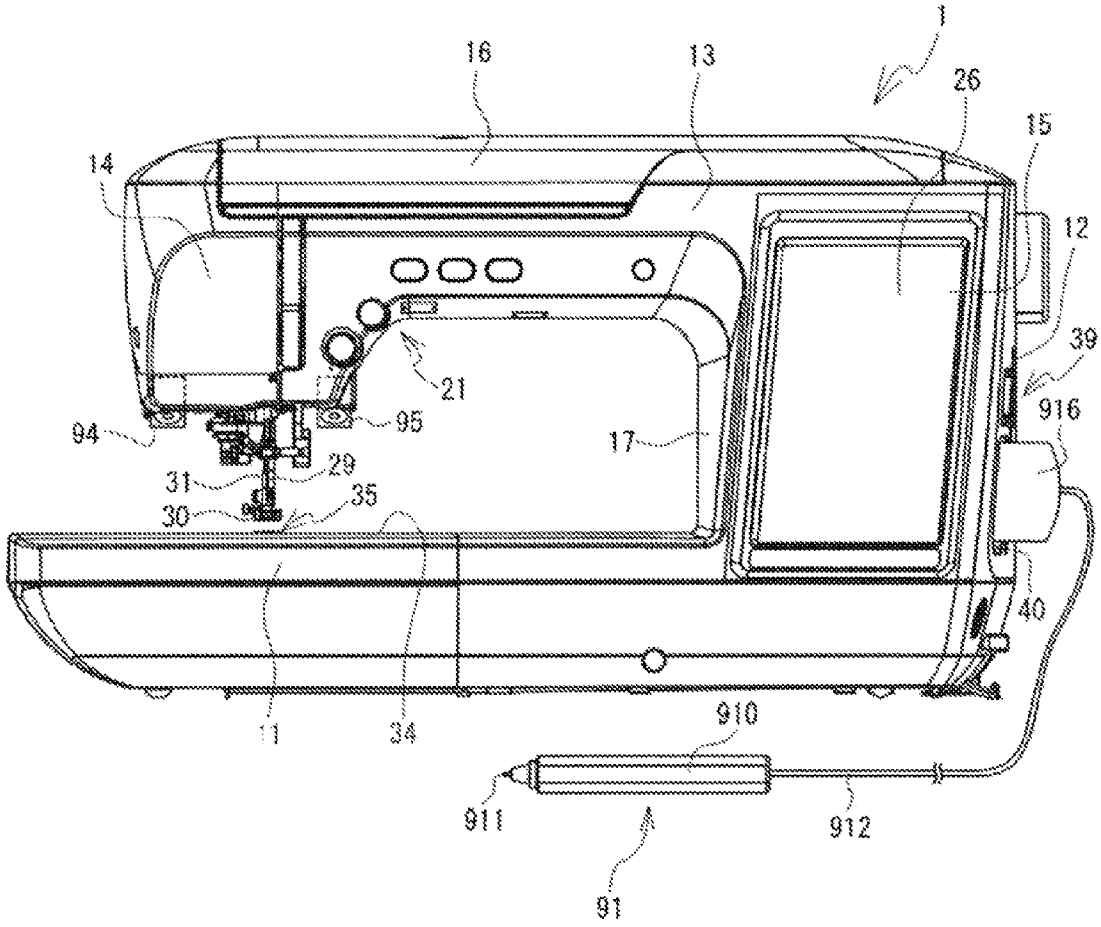
FIG. 1 is a front view of a sewing machine.

Hereinafter, an embodiment will be explained with reference to the drawings. First, the physical configuration of a sewing machine 1 will be explained with reference to FIGS. 1 to 3. The up-down direction, the left-right direction, the front face side, and the rear face side in FIG. 1 are respectively the up-down direction, the left-right direction, the front side, and the rear side of the sewing machine 1. In other words, the face of the sewing machine 1 on which a liquid crystal display which will be described later, is disposed is the front face of the sewing machine 1. The direction in which the longer dimensions of a bed 11 and an arm 13 extend are the left-right direction of the sewing machine 1, and the side on which a pillar 12 is disposed is the right side. The direction in which the pillar 12 extends is the up-down direction of the sewing machine 1.

The sewing machine 1 includes the bed 11, the pillar 12, and the arm 13. The bed 11 is a base portion of the sewing machine 1, and extends in the left-right direction. The pillar 12 extends upward from the right and of the bed 11. The arm 13 extends to the left from the upper end of the pillar 12 such that it is opposite the bed 11. The left end of the arm 13 is a head 14.

A needle plate 34 is disposed in the top face of the bed 11. A feed dog 35 (only the upper edge of which is shown in FIG.

1), a feed mechanism 87 (refer to FIG. 4), as feed motor 82 (refer to FIG. 4), and a shuttle mechanism (not shown in the drawings) are provided underneath the needle plate 34, that is, inside the be 11. The feed dog 35 may be driven by the feed mechanism 87 and is configured to feed a work cloth in a specified feed direction (one of the frontward direction and the rearward direction of the sewing machine 1). The feed mechanism 87 is a mechanism that is configured to move the feed dog 35 in the up-down direction and the front-rear direction. A bobbin around which a lower thread is wound can be accommodated within the shuttle mechanism. The shuttle mechanism is a mechanism that is configured to form a stitch in the work cloth by operating in coordination with a sewing needle not shown in the drawings) that is mounted on a lower end of a needle bar 29, which will be described later. The feed motor 82 is a pulse motor for driving the feed mechanism 87.

The needle bar 29 and a presser bar 31 extend downward from the lower end of the head 14. The sewing needle (not shown in the drawings) can be mounted on and removed from the lower end of the needle bar 29. A presser foot 30 that is configured to press the work cloth from above can be mounted on and removed from the lower end of the presser bar 31. A needle bar up-and-down moving mechanism 86 (refer to FIG. 4), a needle bar swinging mechanism 88 (refer to FIG. 4), and a swinging motor 83 (refer to FIG. 4), and the like are provided inside the head 14. The needle bar up-and-down moving mechanism 86 is a mechanism that is configured to move the needle bar 29 up and down in conjunction with the rotation of a drive shaft. The needle bar swinging mechanism 88 is a mechanism that is configured to swing the needle bar 29 in a direction (the left-right direction) that is orthogonal to the direction the front-rear direction) in which the work cloth is fed by the feed dog 35. The swinging motor 83 is a pulse motor for driving the needle bar swinging mechanism 88.

Receivers 94 and 95 are provided on the rear portion of the lower end of the head 14. The receiver 94 and the receiver 95 have identical structures. The receiver 94 is provided on the rear portion at the lower left edge of the head 14. The receiver 95 is provided on the rear portion at the lower right edge of the head 14. The receivers 94 and 95 are separated from one another by the length of the head 14 in the left-right direction. The receivers 94 and 95 are devices that are configured to detect ultrasonic waves. The receivers 94 and 95 will be described in detail later.

A cover 16 that can be opened and closed is provided in the upper portion of the arm 13. A spool (not shown u the drawings) may be accommodated under the cover 16, that is, approximately in the central portion inside the arm 13. An upper thread (not shown in the drawings) that is wound around the spool may be supplied from the spool to the sewing needle that is mounted on the needle bar 29, by way of a specified path that is provided on the head 14. A plurality of operation switches 21 that include a start-and-stop switch are provided in the lower portion of the front face of the arm 13.

The liquid crystal display (hereinafter called the LCD) 15 is provided on the front face of the pillar 12. An image that includes various types of items, such as commands, illustrations, setting values, messages, and the like, may be displayed on the LCD 15. A touch panel 26 that is configured to detect a position that is pressed is provided on the front face of the LCD 15. When a user uses a finger or a stylus pen to perform a pressing operation on the touch panel 26, the position that is pressed is detected by the touch panel 26. Then, based on the pressed position that has been detected, the item that has been selected in the image is recognized. Hereinafter, the pressing operation that the user performs will be called a panel operation. The user is able to use a panel operation to select as stitch pattern to be sewn or a command to be executed.

Connectors 39 and 40 are provided on the right side face of the pillar 12. An external storage device (not shown in the drawings) such as a memory card or the like may be connected to the connector 39. The sewing machine 1 can acquire sewing data for stitch patterns, as well as various types of programs, from the external storage device that is connected to the connector 39. A connector 916 can be connected to the connector 40. A cable 912 that extends from an ultrasound pen 91 is connected to the connector 916. Through the connector 40, the connector 916, and the cable 912, the sewing machine 1 is able to supply electric power to the ultrasound pen 91. The sewing machine 1 is also able to acquire electrical signals that are output from the ultrasound pen 91.

The ultrasound pen 91 will be explained. The ultrasound pen 91 includes a rod-shaped pen body 910 and a pen tip 911 that is provided on one end of the pen body 910. The pen tip 911 is ordinarily in a projecting position in which the pen tip 911 projects slightly to the outside of the pen body 910. When a force acts on the pen tip 911 in the direction toward the pen body 910, the pen tip 911 is pushed into the pen body 910. When the force that is acting, on the pen tip 911 ceases, the pen tip 911 returns to the projecting position.

The ultrasound pen 91 includes a switch 913 (refer to FIG. 4), a signal output circuit 914 (refer to FIG. 4), and an ultrasound transmitter 915 (refer to FIG. 4) inside the pen body 910. When the pen tip 911 is in the projecting position, the switch 913 is in an OFF state. When the switch 913 is in the OFF state, the signal output circuit 914 does not output an electrical signal, and the ultrasound transmitter 915 does not transmit ultrasonic waves. On the other hand, when the pen tip 911 is pressed and is pushed into the pen body 910, the switch 913 enters an ON state. When the switch 913 enters the ON state, the signal output circuit 914 outputs an electrical signal to the sewing machine 1 through the cable 912, and the ultrasound transmitter 915 transmits ultrasonic waves.

As will be described in detail later, the sewing machine 1 is capable of detecting (receiving) the ultrasonic waves that are transmitted, from the ultrasound pen 91, using the receivers 94 and 95. The sewing machine 1 is able to identify the position of the transmission source of the ultrasonic waves, that is, the ultrasound transmitter 915 that is provided in the ultrasound pen 91, based on the detected ultrasonic waves.

The receivers 94 and 95 will be explained with reference to FIGS. 2 and 3. The structure of the receiver 95 is identical to that of the receiver 94, so an explanation of the receiver 95 will be omitted. The up-down direction, the left-right direction, the front face side, and the rear face side in FIG. 2 are respectively the up-down direction, the kit-right direction, the front side, and the rear sick of the receiver 94.

Figure 2:
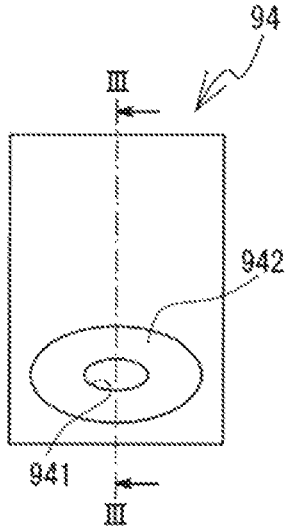
FIG. 2 is a front view of a receiver.
Figure 3:
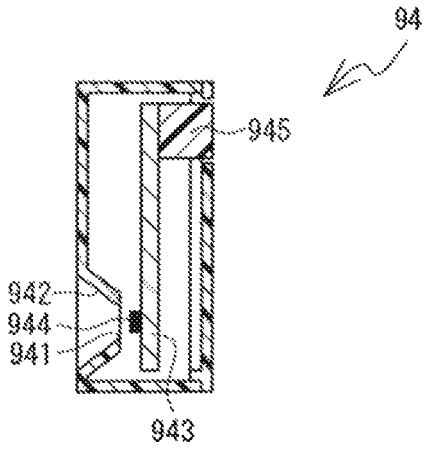
FIG. 3 is a section view of the receiver, as seen from the direction of arrows on a line III-III that is shown in FIG. 2.

As shown in FIGS. 2 and 3, the receiver 94 has a three-dimensional rectangular shape and has an elliptical opening 941 in the center of the lower portion of its front face. A surrounding portion 942 that surrounds the opening 941 is at tapered surface (an inclined surface) that makes the diameter become larger toward the front side. As shown in FIG. 3, an electrical circuit board 943 and a microphone 944 are provided, in the interior of the receiver 94. The microphone 944 is positioned on the inner side of the opening 941. A connector 945 is mounted on the rear face of the upper end of the electrical circuit board 943. The connector 945 is connected to a connector (not shown in the drawings) that is provided in the Sewing machine 1. The directionality of the receiver 94 may be determined by the orientation of the opening 941 in relation to the microphone 944.

Figure 4:
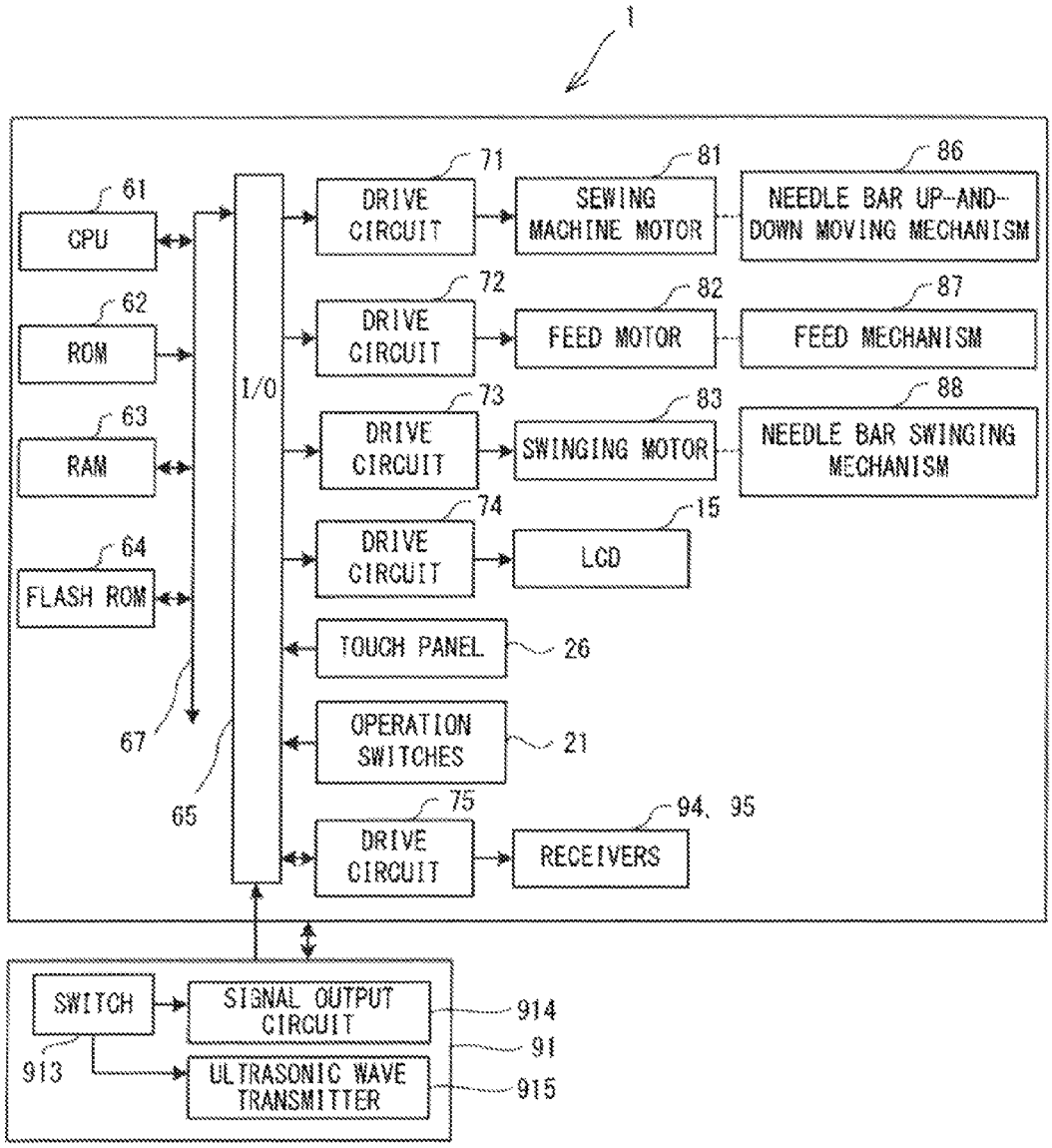
FIG. 4 is a block diagram that shows electrical configurations of the sewing machine and an ultrasound pen.

The electrical configuration of the sewing, machine 1 will be explained with reference to FIG. 4. The sewing machine 1 includes a CPU 61, as well as with a ROM 62, a RAM 63, a flash ROM 64, and an input/output interface (I/O) 65 that are each connected to the CPU 61 by a bus 67.

The CPU 61 is configured to perform main control of the sewing machine 1. The CPU 61 may perform various types of calculations and processing that are related to sewing in accordance with various types of programs that are stored in the ROM 62. The ROM 62 has a plurality of storage areas, including a program storage area and a stitch pattern storage area, although these are not shown in the drawings. Various types of programs for operating the sewing machine 1 are stored in the program storage area. The stored programs may include, for example, a program that causes the sewing machine 1 to perform sewing ending position adjustment processing, which will be described later. The sewing data for sewing each of the stitch patterns are stored in the stitch pattern storage area.

In the present embodiment, the sewing data for each of the stitch patterns include at least feed amount data that indicate planned feed amounts for the feeding of the work cloth by the teed dog 35. More specifically, each of the planned feed amounts is as target value for a distance by which the work cloth is to be moved in the feed direction (that is, a distance by which the work cloth is to be fed by the feed dog 35) when each of the individual stitches of the stitch pattern is formed. Accordingly, the number of items of the feed amount data that are included in the sewing data for each of the stitch patterns is equal to the number of the stitches that will be formed. In the present embodiment, data that indicate the number of drive pulses (including a motor rotation direction) to be imparted to the feed motor 82 for feeding the work cloth by the planned feed amount is used as each feed amount data item. In a case where the stitch pattern is a stitch pattern, such as a zigzag stitch or the like, for which swinging of the needle bar 29 is performed during the sewing, the sewing data include, in addition to the feed amount data, swing amount data that indicate planned swing amounts for the swinging of the needle bar 29 by the needle bar swinging mechanism 88. For example, each swing amount data item may be data that indicate the number of drive pulses (including a motor rotation direction) to be imparted to a swinging motor 83 for forming each of the individual stitches.

A storage area for storing calculation results and the like from calculation processing that the CPU 61 has performed may be provided in the RAM 63 as necessary. Various types of parameters for the sewing machine 1 to perform various types of processing may be stored in the flash ROM 64. Drive circuits 71 to 74, the touch panel 26, the operation switches 21, and a drive circuit 75 are connected to the I/O 65.

A sewing machine motor 81 is connected to the drive circuit 71. The drive circuit 71 may drive the sewing machine motor 81 in accordance with a control signal from the CPU 61. In conjunction with the driving of the sewing machine motor 81, the needle bar up-and-down moving mechanism 86 is driven through the drive shaft (not shown in the drawings) of the sewing machine 1, and the needle bar 29 is moved up and down. The feed motor 82 is connected to the drive circuit 72. The drive circuit 72 may drive the feed motor 82 in accordance with a control signal from the CPU 61. In conjunction with the driving of the feed motor 82, the feed mechanism 87 moves the feed dog 35 up and down and toward the front and the rear, thus feeding the work cloth by a feed amount in accordance with the control signal. The swinging motor 83 is connected to the drive circuit 73. The drive circuit 73 may drive the swinging motor 83 in accordance with a control signal from the CPU 61. In conjunction with the driving of the swinging motor 83, the needle bar swinging mechanism 88 moves the needle bar 29 to the left and the right, thus swinging the needle bar 29 by a swing amount in accordance with the control signal. The drive circuit 74 may cause the LCD 15 to display an image by driving the LCD 15 in accordance with a control signal from the CPU 61.

The receivers 94 and 95 are connected to the drive circuit 75. The drive circuit 75 may drive the receivers 94 and 95 in accordance with a control signal from the CPU 61. The drive circuit 75 includes an amplifier circuit that is configured to amplify the ultrasonic wave signals that are detected by the receivers 94 and 95 and to transmit the ultrasonic wave signals to the CPU 61.

The electrical configuration of the ultrasound pen 91 will be explained with reference to FIG. 4. The ultrasound pen 91 includes the switch 913, the signal output circuit 914, and the ultrasound transmitter 915. The switch 913 is electrically connected to the signal output circuit 914 and the ultrasound transmitter 915. The signal output circuit 914 is electrically connectable to the I/O 65. The signal output circuit 914 is able to output an electrical signal to the CPU 61 through the I/O 65.

Figure 5:
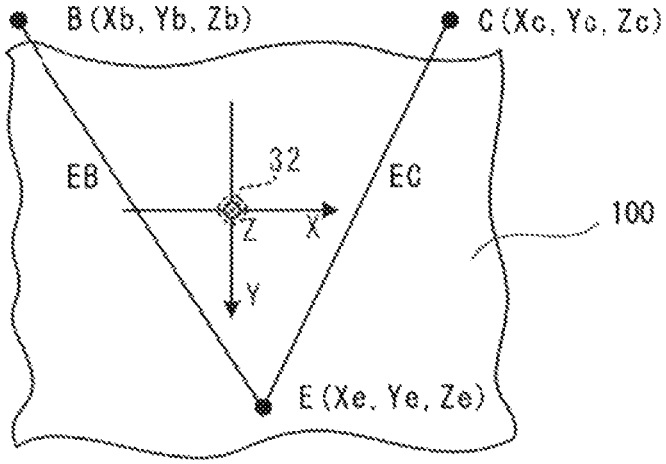
FIG. 5 is an explanatory figure of a method for identifying coordinates E that indicate a designated position.

The method by which the CPU 61 identifies a position on a work cloth 100 that is designated by the user with the ultrasound pen 91 will be explained with reference to FIG. 5. The user may designate a desired position on the work cloth 100 by pressing, the pen tip 911 of the ultrasound pen 91 against the work cloth 100. Hereinafter, the position on the work cloth 100 against which the pen tip 911 is pressed will also be called a designated position. The CPU 61 of the sewing machine 1 may identify the designated position by identifying the position of the transmission source of the ultrasonic waves. Therefore, strictly speaking, the position that the CPU 61 identifies is not the position on the work cloth 100 against which the pen tip 911 is pressed, hut is the position of the ultrasound transmitter 915 of the ultrasound pen 91. However, the pen tip 911 and the ultrasound transmitter 915 are located extremely close to one another. Therefore, the position of the ultrasound transmitter 915 can be regarded as the position on the work cloth 100 against which the pen tip 911 is pressed, that is, as the designated position.

The sewing machine 1 may identify the designated position in the form of three-dimensional coordinates (an X coordinate, a Y coordinate, and a Z coordinate) of a world coordinate system. In the sewing machine 1 of the present embodiment, the origin point (0, 0, 0) of the world coordinate system is defined as being at the center of a needle hole 32, and the left-right direction, the front-rear direction, and the up-down direction of the sewing machine 1 are respectively defined as the X axis direction, the Y axis direction, and the Z axis direction. The left-right direction and the up-down direction in FIG. 5 respectively correspond to the X axis direction and the Y axis direction, and the direction that is orthogonal to the plane of FIG. 5 corresponds to the Z axis direction. The needle hole 32 is a hole that is formed in the needle plate 34 (refer to FIG. 1) in a position that is directly beneath the needle bar 29. The sewing needle (not shown in the drawings) that is mounted on the needle bar 29 may pass through the needle hole 32 in the up-down direction during the sewing.

The plane on which the Z coordinate is zero indicates the top face of the needle plate 34. Coordinates B that indicate the position of the microphone 944 of the receiver 94 are defined as (Xb, Yb, Zb). Coordinates C that indicate the position of the microphone 944 of the receiver 95 are defined as (Xc, Yc, Zc). The coordinates 13 (Xb, Yb, Zb) and the coordinates C (Xc, Yc, Zc) may be stored in the ROM 62 in advance. The respective Z coordinates of the receivers 94 and 95 indicate the heights of the receivers 94 and 95 in relation to the top face of the needle plate 34. Coordinates E that indicate the designated position are defined as (Xe, Ye, Ze). The distance between the coordinates E and the coordinates B will be called the distance EB, and the distance between the coordinates E and the coordinates C will be called the distance EC.

Based on the Pythagorean theorem, the distances EB, EC can be described by the coordinates B, C, E. The relationship among the distance EB, the coordinates B, and the coordinates E is described by Equation (1) below. In the same manner, the relationship among the distance EC, the coordinates C, and the coordinates F is described by Equation (2) below.

$$(Xb-Xe)^2+(Yb-Ye)^2+(Zb-Ze)^2=(EB)^2 \quad (1):$$

$$(Xc-Xe)^2+(Yc-Ye)^2+(Zc-Ze)^2=(EC)^2 \quad (2):$$

Note that Equation (1) is identical to an equation for a spherical surface that has a radius of the distance EB, that has the center point that is defined by the coordinates B, and that intersects the coordinates E. In the same manner, Equation (2) is identical to an equation for as spherical surface that has a radius of the distance EC, that hats the center point that is defined by the coordinates C, and that intersects the coordinates E.

The velocity at which the ultrasonic waves travel is the velocity of sound V. The times that are required for the ultrasonic waves, which are transmitted from the ultrasound pen 91 that designates the coordinates E, to be detected by the receivers 94 and 95 are respectively defined as a transmission time Tb and a transmission time Tc. In this case, the distances EB and EC can respectively be described by Equations (3) and (4) below.

$$EB=V\times Tb \quad (3):$$

$$EC=V\times Tc \quad (4):$$

Substituting Equations (3) and (4) into Equations (1) and (2) yields Equations (5) and (6) below, $$(Xb-Xe)^2+(Yb-Ye)^2+(Zb-Ze)^2=(V\times Tb)^2 \quad (5):$$

$$(Xc-Xe)^2+(Yc-Ye)^2+(Zc-Ze)^2=(V\times Tc)^2 \quad (6):$$

In Equations (5) and (6), the coordinates B (Xb, Yb, Zb), the coordinates C (Xc, Yc, Zc) and the velocity of sound V are known values, which are stored in the ROM 62. The time when the ultrasonic waves are transmitted from the ultrasound transmitter 915 of the ultrasound pen 91 is defined as the transmission time T1. The times when the ultrasonic waves are detected by the receivers 94 and 95 are defined as the detection time T2*b* and the detection time T2*c*, respectively. In this case, the transmission times Tb and Tc can be identified by calculating the difference between the transmission time T1 and the detection time T2*b* and the difference between the transmission time T1 and the detection time T2*c*, respectively. In the present embodiment, the feed dog 35 does not move the work cloth 100 in the Z axis direction (the up-down direction of the sewing machine 1). Therefore, as long as the thickness of the work cloth 100 is within a range where the thickness can be ignored, the Z coordinate of the position of the top face of the work cloth 100 may be defined as zero. Accordingly, the CPU 61 can calculate the coordinates E (Xe, Ye, Ze) (Ze=0) based on the simultaneous Equations (5) and (6) and on the directionalities of the receivers 94 and 95.

The sewing ending position adjustment processing in the present embodiment will be explained with reference to FIGS. 6 to 9. The sewing ending position adjustment processing is started, when the user inputs through a panel operation, for example, a command to start processing in which the ultrasound pen 91 will be used to adjust a sewing ending position. A program for performing the sewing ending position, adjustment processing is stored in the ROM 62 (refer to FIG. 4), and the CPU 61 loads the program into the RAM 63 and executes the program.

Figure 6:
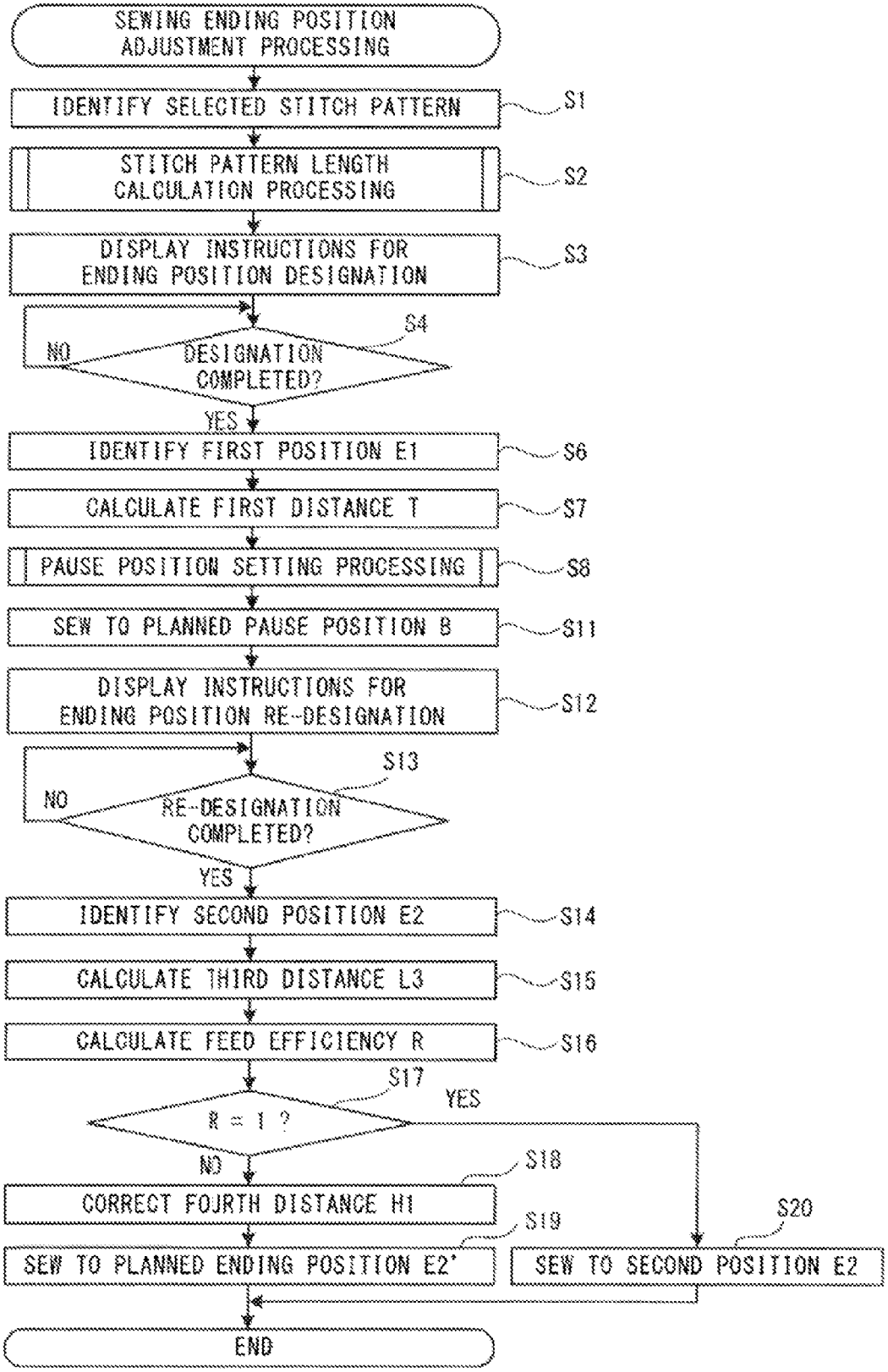
FIG. 6 is a flowchart of sewing ending position adjustment processing.

As shown in FIG. 6, first, the CPU 61 identifies a stitch pattern (hereinafter called a selected stitch pattern) that is selected by the user as a stitch pattern to be sewn (Step S1). Specifically, a screen may be displayed on the LCD 15, for example, that shows a plurality of stitch patterns that can be sewn by the sewing machine 1 and for which the sewing data are stored in the ROM 62. When the user selects one of the displayed stitch patterns through a panel operation, that stitch pattern is identified as a selected stitch pattern, and the sewing data for the selected stitch pattern are read from the ROM 62 and stored in the RAM 63. Note that in a case where a plurality of stitch patterns are selected for sewing, the selected stitch patterns include a plurality of stitch patterns. In that case, the CPU 61 stores the sewing data for the plurality of stitch patterns in the RAM 63, in the order in which the stitch patterns are selected. The CPU 61 also stores data in the RAM 63 that indicate as number M that is the number of the selected stitch patterns.

Figure 7:
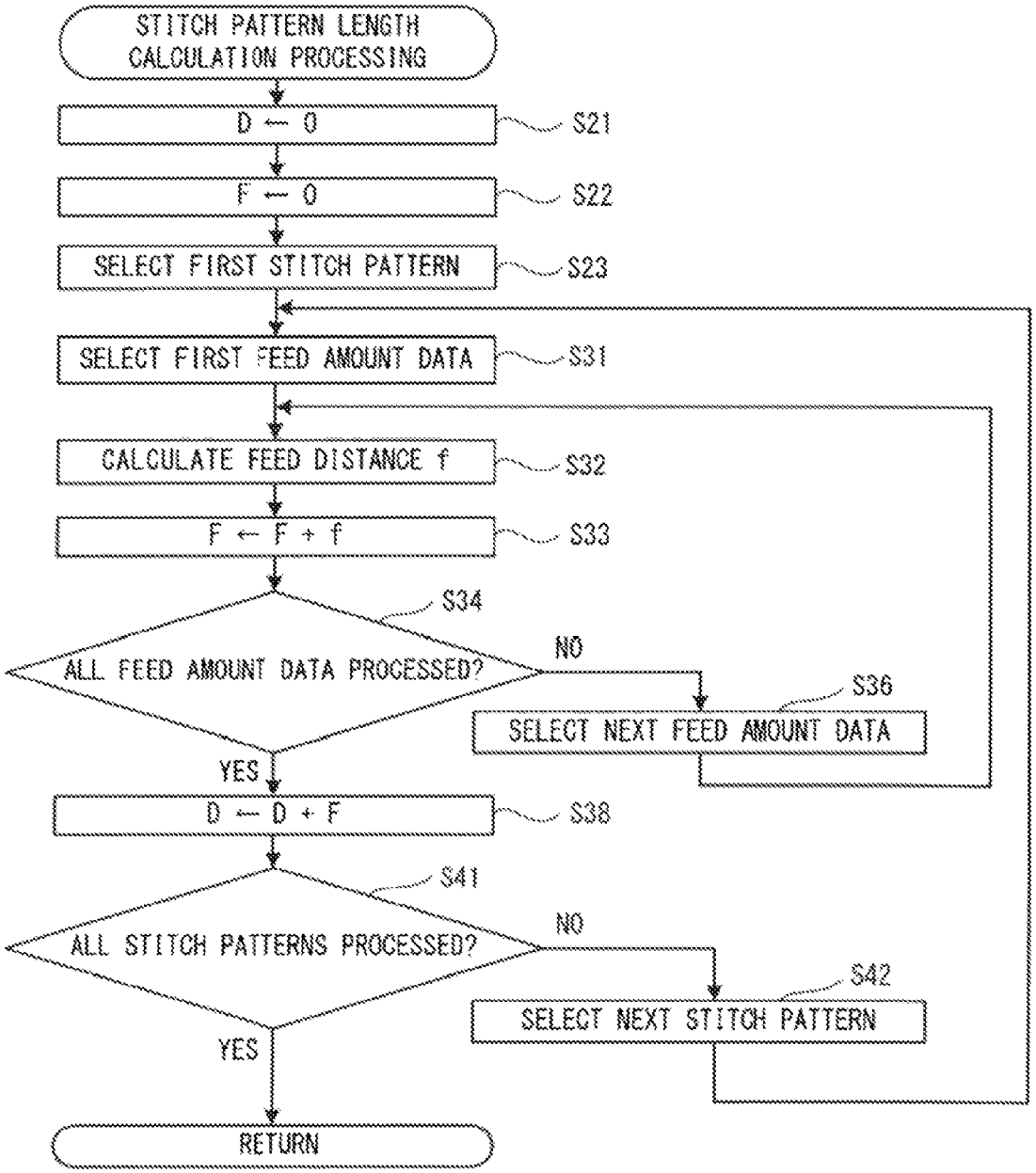
FIG. 7 is a flowchart of stitch pattern length calculation processing that is performed in the sewing ending position adjustment processing.

The CPU 61 performs stitch pattern length calculation processing Step S2; FIG. 7). The stitch pattern length calculation processing is processing that, based on the sewing data for the selected stitch pattern/patterns, calculates the total length of the selected stitch pattern/patterns (hereinafter called the selected stitch pattern length) in the feed direction. As shown in FIG. 7, in the stitch pattern length calculation processing, the CPU 61 initializes a variable D, which specifies the selected stitch pattern length, by setting the variable D to zero (Step S21). The CPU 61 also initializes a variable F, which specifies an individual stitch pattern length, by setting the variable F to zero (Step S22). The individual stitch pattern length is a length, in the feed direction, of an individual stitch pattern that is included in the selected stitch pattern/patterns.

From the sewing data for the selected stitch pattern/patterns that were stored in the RAM 63 at Step S1, the CPU 61 selects sewing data for a first stitch pattern as an object of the processing (Step S23). The CPU 61 selects first feed amount data, which are included in the sewing data for the stitch pattern that is the object of the processing (Step S31), then calculates a feed distance f for one stitch, based on the feed amount data (Step S32). The CPU 61 updates the variable F by adding the calculated value of the feed distance f to the variable F that is stored in the RAM 63 (Step S33).

The CPU 61 determines whether or not all of the feed amount data for the stitch pattern that is the object of the processing have been processed (Step S34). For example, the CPU 61 can determine whether or not all of the feed amount data have been processed by counting the number of the feed amount data items that have been processed and comparing that number to the number of the feed amount data items that, are included m the sewing data for the stitch pattern that is the object of the processing. In a case where there are unprocessed feed amount data remaining (NO at Step S34) the CPU 61 selects feed amount data that correspond to the next stitch from the unprocessed feed amount data (Step S36) and returns the processing to Step S32. The CPU 61 repeats the processing that calculates the feed distance f for one stitch and adds the feed distance f to the variable F, as described above, until there are no unprocessed feed amount data remaining. When the processing has been completed for all of the feed amount data for the stitch pattern that is the object of the processing YES at Step S34), the value of the variable F indicates the feed distance for the single stitch pattern. Accordingly, the CPU 61 updates the variable D by adding the variable F to the variable D that is stored in the RAM 63 (Step S38). The CPU 61 also formulates as value Fn (where n is an integer from 1 to M) that associates the value of the variable F with a value that identifies the sequence number of the stitch pattern for which the processing has been completed, among the selected stitch pattern/patterns. The CPU 61 then stores the value Fn in the RAM 63.

The CPU 61 determines whether or not all of the stitch pattern/patterns that are included in the selected stitch pattern/patterns have been processed (Step S41). For example, the CPU 61 can determine whether or not all of the stitch pattern/patterns have been processed by counting the number of the stitch pattern/patterns that have been processed and comparing that to the number M of the stitch pattern/patterns that are included in the selected stitch patterns. In a case where there are one or more unprocessed stitch patterns remaining (NO) at Step S41), the CPU 61 selects the next stitch pattern from the one or more unprocessed stitch patterns (Step S42) and returns the processing to Step S31. The CPU 61 repeats the processing that calculates the feed distance for each stitch pattern, that is, the variable F, and adds the variable F to the variable D, until there is no unprocessed stitch pattern remaining. When there is no unprocessed stitch pattern remaining (YES at Step S41), the value of the variable D indicates the total feed distance for the M stitch pattern/patterns that are included in the selected stitch pattern/patterns. Namely, the variable D indicates the selected stitch pattern length. The CPU 61 terminates the stitch pattern length calculation processing in FIG. 7 and returns to the sewing ending position adjustment processing in FIG. 6.

As shown in FIG. 6, the CPU 61, following the stitch pattern length calculation processing (Step S2), provides information to the user to prompt the user to designate an ending position for the sewing (Step S3). For example, at Step S3, the CPU 61 may cause the LCD 15 to display a message screen that prompts the user to designate, using the ultrasound pen 91, a position where the sewing of the selected stitch patterns is to end. All the user needs to do is press the pen tip 911 of the ultrasound pen 91 against the work cloth 100 at the position where the sewing of the selected, stitch patterns is to end (hereinafter simply called the ending position).

The CPU 61 determines whether or not the designating of the ending position has been completed (Step S4). When the pen tip 911 is pressed against the work cloth 100, the signal output circuit 914 (refer to FIG. 4) outputs the electrical signal through the cable 912. At the same time, the ultrasound transmitter 915 (refer to FIG. 4) transmits the ultrasonic waves. The CPU 61 identifies the time when the CPU 61 detects the electrical signal that was output from the signal output circuit 914 as the transmission time T1. The CPU 61 identifies the times when the CPU 61 recognizes that the receivers 94 and 95 have detected the ultrasonic waves as the detection time T2*b* and the detection time T2*c*, respectively. Accordingly, for as long as one of the detection times T2*b* and T2*c* has not been identified in addition to the transmission time T1, the CPU 61 determines that the designating of the ending position has not been completed (NO at Step S4), and the CPU 61 waits.

In a case where the transmission time T1 and the detection times T2*b* and T2*e* have all been identified, the CPU 61 determines that the designating of the ending position has been completed (YES at Step S4), The CPU 61 identifies the coordinates of the designated position based on the previously described simultaneous equations and the directionalities of the receivers 94 and 95 (Step S6). Hereinafter, the designated position that is identified before the sewing starts, for which the coordinates are identified at Step S6, will be called a first position E1. The CPU 61 calculates the distance to the first position E1 from a reference position S, where the sewing will be started, as a first distance T, which is the length over which the sewing of the selected stitch patterns will be performed (Step S7). The reference position S, where the sewing will be started, is the position where the sewing needle will be lowered and pierce the work cloth 100 for the first time. In other words, the reference position S is the center point of the needle hole 32, that is, the origin point of the world coordinate system. Accordingly, based on the coordinates of the first position E1 that are identified at Step S6, the CPU 61 is able to calculate the distance between the origin point and the first position E1 as the first distance T.

Figure 8:
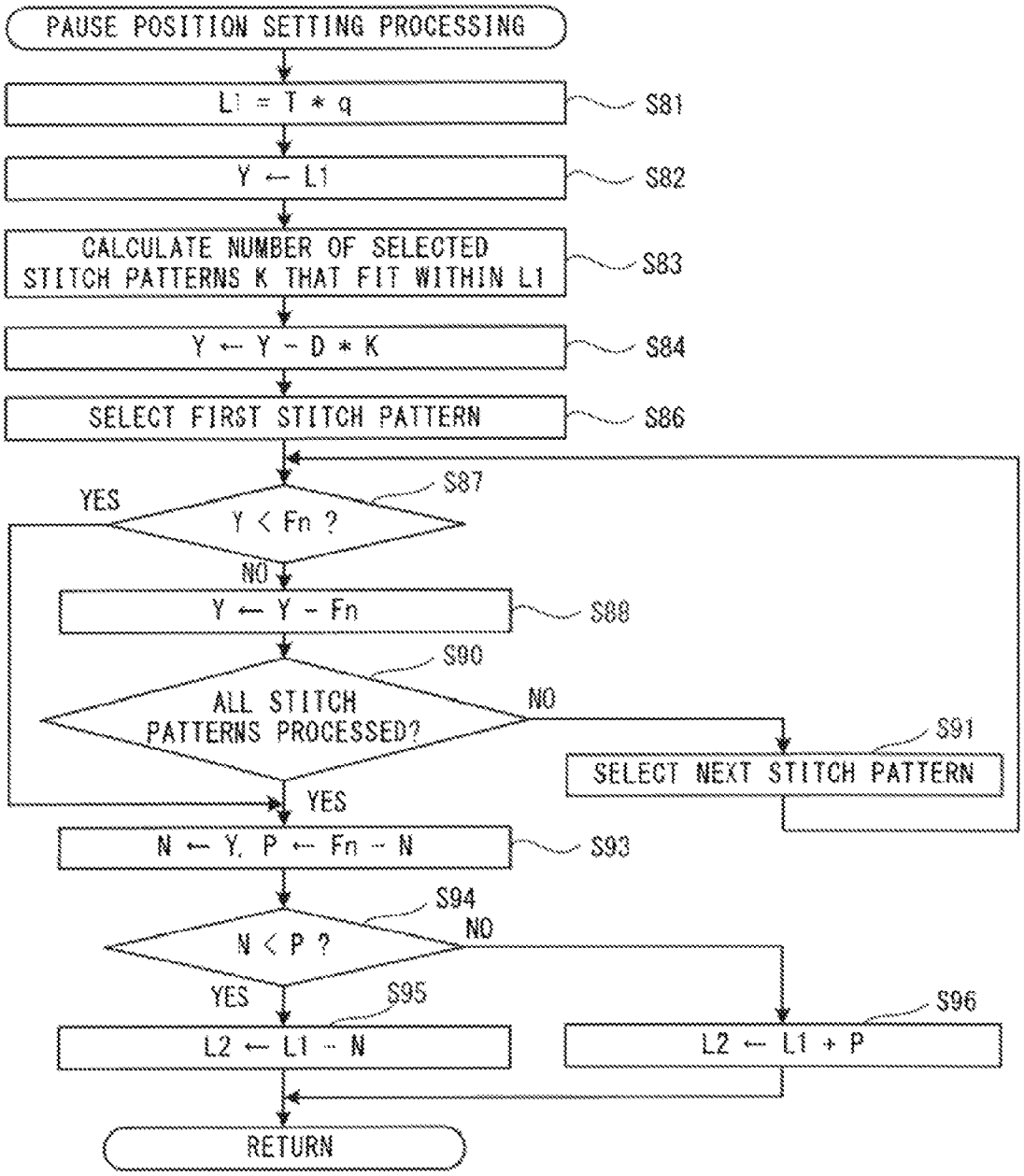
FIG. 8 is a flowchart of pause position setting processing that is performed in the sewing ending position adjustment processing.
Figure 9:
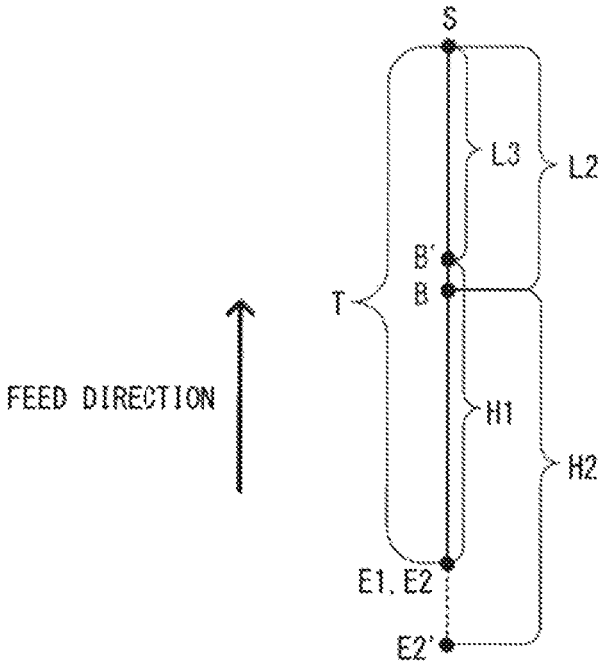
FIG. 9 is an explanatory figure of the relationships among a first distance, a second distance, a third distance, a fourth distance, and a fifth distance.

The CPU 61 performs pause position setting processing (Step S8; FIG. 8). The pause position setting processing is processing that sets a planned pause position B. As shown in FIG. 9, the planned pause position B is a position between the reference position S and the first position E1 where the sewing is planned to be paused in order for the actual feed efficiency of the feed dog 35 to be examined and the remaining, length over which the sewing will be performed to be adjusted accordingly.

As shown in FIG. 8, in the pause position setting processing, first, the CPU 61 calculates a target distance L1 from the reference position S in order to set the planned pause position B (Step S81). Specifically, the CPU 61 calculates the distance L1 by multiplying the first distance T that was calculated at Step S7 by a coefficient q. The coefficient q may be any value that is greater than zero and less than 1. The coefficient q may be a value (for example, 0.5) that is determined in advance and stored in the flash ROM 64. The coefficient q may also be a value that is designated by the user of the sewing machine 1 prior to the processing at Step S81. Realistically, it is preferable for the coefficient q to be a value that is not too close to either one of zero and 1, because the planned pause position B is a position where the sewing will be paused in order for the remaining length over which the sewing will be performed to be adjusted.

The CPU 61 sets a variable Y to the calculated value of the distance L1 and stores the variable Y in the RAM 63 (Step S82). The variable Y is a variable for tracking the distance, within the distance L1, over which the selected stitch pattern/patterns will not been sewn. By dividing the distance L1 by the selected stitch pattern length D that was calculated by the stitch pattern length calculation processing at Step S2, the CPU 61 calculates the number of the selected stitch patterns that will fit within the distance L1 that is, a number of iterations K that the selected stitch pattern/patterns will be repeatedly sewn (Step S83). The CPU 61 multiplies the calculated number of iterations K by the selected stitch pattern length D, and updates the variable Y by subtracting the resulting value from the variable Y that is stored in the RAM 63 (Step S84). In other words, the variable Y that has been updated at Step S84 indicates the distance remaining within the distance L1 when the selected stitch pattern/patterns are repeatedly sewn K times.

The CPU 61 selects the first stitch pattern from the selected stitch pattern/patterns as the object of the processing (Step S86). The CPU 61 determines whether or not the value of Fn that was stored at the previously described Step S38, that is, the value that indicates the feed distance for a single iteration of the n-th stitch pattern (n being equal to 1 in the first round of the processing), is greater than the variable Y (Step S87). In a case where Fn is not greater than the variable Y (NO at Step S87), the length of the entire stitch pattern will not exceed the distance L1 even if the stitch pattern that is the object of the processing is sewn. Accordingly, the CPU 61 updates the variable Y by subtracting Fn from the variable Y (Step S88). The CPU 61 determines whether or not all of the stitch pattern/patterns that are included in the selected stitch pattern/patterns have been processed (Step S90). In a case where there are one or more unprocessed stitch patterns remaining (NO at Step S90), the CPU 61 selects the next stitch pattern from the one or more unprocessed stitch patterns (Step S91) and returns the processing to Step S87.

In a case where Fn is greater than the variable Y (YES at Step S87), the length of the entire stitch pattern would exceed the distance L1, if the stitch pattern that is the object of the processing is sewn. Accordingly, the stitch pattern that is the object of the processing will not be sewn. The CPU 61 advances the processing to Step S93, which will be described later. Note that in the present embodiment, the total length of the stitch patterns will definitely exceed the distance L1 before the processing is completed for all of the stitch patterns, so a case in which the CPU 61 determines that the processing has been completed for all of the stitch patterns (YES at Step S90) will not occur.

At Step S93, the CPU 61 sets a variable N to the value of the variable Y and stores the variable N in the RAM 63. The CPU 61 also subtracts the variable N from the feed distance Fn for a single iteration of the n-th stitch pattern that is the object of the processing, then stores the resulting value as a variable P in the RAM 63 (Step S93). When a position that is separated from the reference position S by the distance L1 is defined as a position L, the variable N indicates a distance to a delimiting position P1 of a stich pattern that is the closest delimiting position from the position L in a direction from the position L toward the reference position S. The variable P indicates a distance to a delimiting position P2 of a stitch pattern that is the closest delimiting position from the position L in a direction opposite from the reference position S. Note that the delimiting position P1 that is the closest front the position L in the direction from the position L toward the reference position S is the position of the last needle drop point of the last stitch pattern that will be sewn before the position L is reached. The delimiting position P2 that is the closest from the position L in the opposite direction from the reference position S is the position of the last needle drop point of the stitch pattern that will be sewn through the position L.

In a ease where the variable P is greater than the variable N (YES at Step S94), the delimiting position P1, which is on the side toward the reference position S, is closer to the position L than is the delimiting position P2. Accordingly, the CPU 61 sets the position P1 as the planned pause position B. The CPU 61 subtracts the variable N from the distance L1 and stores the resulting value in the RAM 63 as a second distance L2, which is the planned feed distance from the reference position S to the planned pause position B (Step S95). The CPU 61 also specifies the last sewing data that will be used in the sewing up to the planned pause position B, that is, the last sewing data for the stitch pattern that defines the delimiting position P1, then stores data that identify the sewing data in the RAM 63, together with the number of iterations K that the stitch pattern will be repeatedly sewn. The CPU 61 terminates the pause position setting processing in FIG. 8 and returns to the sewing ending position adjustment processing in FIG. 6.

In a case where the variable P is not greater than the variable N (NO at Step S94), either the distances from the position L to the delimiting positions P1 and P2 are equal, or the delimiting position P2, which is on the opposite side of the position L from the reference position S, is closer to the position L than is the delimiting position P1. In that case, the CPU 61 sets the position P2 as the planned pause position L then adds the variable P to the distance L1 and stores the resulting value in the RAM 63 as the second distance L2 from the reference position S to the planned pause position B (Step S96). The CPU 61 also specifies the last sewing data that will be used in the sewing, up to the planned pause position B, that is, the last sewing data for the stitch pattern that defines the delimiting position P2, then stores data that identify the sewing data in the RAM 63, together with the number of iterations K that the stitch pattern will be repeatedly sewn. The CPU 61 terminates the pause position setting processing in FIG. 8 and returns to the sewing ending position adjustment processing in FIG. 6.

As shown in FIG. 6, after the pause position setting processing (Step S8), when the CPU 61 detects that the user has pressed the start-and-stop switch, the CPU 61 performs sewing, processing up to the planned pause position B in accordance with the sewing data for the selected stitch pattern/patterns (Step S11).

Specifically, the CPU 61 operates the sewing machine motor 81 (refer to FIG. 4) through the drive circuit 71, causing the drive shaft (not shown in the drawings) to rotate. The needle bar up-and-down moving mechanism 86 (refer to FIG. 4) is driven by the rotation of the drive shaft to move the needle bar 29, on which the sewing needle (not shown in the drawings) is mounted, up and down. Further, the shuttle mechanism (not shown in the drawings) is driven by the sewing machine motor 81 in synchronization with the up-down movement of the needle bar 29, such that the shuttle is rotated. The CPU 61 also operates the feed motor 82 (refer to FIG. 4) through the drive circuit 72, in accordance with the teed amount data that are included in the sewing data. The feed dog 35 is thus moved in synchronization with the up-down movement of the needle bar 29. In a case where the swing amount data are included in the sewing data, the CPU 61 operates the swinging motor 83 (refer to FIG. 4) through the drive circuit 73, in accordance with the swing amount data, thereby swinging the needle bar 29 in synchronization with the feeding of the work cloth 100 by the feed dog 35.

By reading the sewing data sequentially and repeating the processing, the CPU 61 causes the sewing machine 1 to form the stitches of the selected stitch pattern/patterns. When the cycle of forming the stitches in accordance with the sewing data that are indicated by the identifying data has been performed as many times as 1 has been added to the number of iterations K that was stored in the RAM 63 at one of Steps S95 and S96 in the pause position setting processing, the CPU 61 determines that the sewing has been completed up to the planned pause position B, and the CPU 61 pauses the sewing processing.

The CPU 61 provides information that prompts the user to designate the sewing ending position once again (Step S12). For example, at Step S12, the CPU 61 may cause the LCD 15 to display a message screen that prompts the user to designate with the ultrasound pen 91, as the ending position, the same position that was designated at Step S3. All the user needs to do is press the pen tip 911 of the ultrasound pen 91 against the work cloth 100 at the ending position.

The CPU 61 determines, by the same method as at Step S4, whether or not the designating of the ending position has been completed (Step S13). For as long as the re-designating of the ending position has not been completed (NO at Step S13), the CPU 61 waits. In as case where the re-designating of the ending position has been completed (YES at Step S13), the CPU 61 identifies the coordinates of the designated position by the same method as at Step S6 (Step S14). Hereinafter, the designated position that is designated after the sewing has been paused, for which the coordinates are identified at Step S14, will be called a second position E1. In the present embodiment, the subsequent processing is performed on the assumption that the ending positions that the user designates at Steps S3 and S12 are the same, that is, that the first position E1 and the second position E2 are the same.

Note that in order to cause the user to accurately designate the same ending position on the work cloth 100 at Steps S3 and S12, the CPU 61, at Step S3, may also cause the LCD 15 to display a message that prompts the user to make a mark at the ending position in advance, with a fabric marking pencil, before designating the ending position with the ultrasound pen 91. The pen tip 911 of the ultrasound pen 91 may also be provided with an ink, discharge portion that is configured to discharge a small amount of water-soluble ink when the pen tip 911 is pressed against the work cloth 100. In a case where the stitch patterns have been printed on the work cloth 100 itself, or where the work cloth 100 itself has a woven pattern, it is not necessary for the user to make a separate mark if an identifiable mark on the work cloth 100 is designated as the ending position.

The CPU 61 calculates, as a third distance L3 (refer to FIG. 9), the distance from the reference position S, where the sewing started, to an actual pause position B', which is the position where the sewing was actually paused, that is, the distance that the work cloth 100 was actually fed by the feed dog 35 at Step S11 (Step S15).

Specifically, the CPU 61 can calculate the third distance L3 by a procedure that will now be explained. At the point when the sewing is paused at Step S11, the actual pause position B' is directly beneath the sewing needle, that is, directly above the center point of the needle hole 32. In other words, the actual pause position B' is at the origin point. Accordingly, the CPU 61, based on the coordinates of the second position E2 that were identified at Step S14, calculates the distance from the origin point to the second position E2 as a fourth distance H1 (refer to FIG. 9) from the actual pause position B' to the second position E2. As explained previously, in the present embodiment, the first position E1 and the second position E2 that have both been designated as the ending position are treated as the same position. Accordingly, the distance from the reference position S to the second position E2 is equal to the first distance T from the reference position S to the first position E1, which was calculated at Step S7. Accordingly, the CPU 61 may calculate the third distance L3 by subtracting the fourth distance H1 from the first distance T.

Based on the second distance L2 and the third distance L3, the CPU 61 calculates a feed efficiency R, which is the efficiency of the feeding of the work cloth 100 by the feed mechanism 87 and the teed dog 35 (Step S16). Specifically, the CPU 61 calculates the feed efficiency R by dividing the third distance L3 by the second distance L2 (L3/L2). The CPU 61 determines whether or not the feed efficiency R is 1 (Step S17).

In a case where the feed efficiency R is not 1 that is, is not 100% (NO at Step S17), the actual feed distance does not match the target value (the planned feed distance) that is prescribed by the feed amount data in the sewing data. In other words, as shown in FIG. 9, the second distance 112 from the reference position S to the planned pause position B does not match the third distance L3 from the reference position S to the actual pause position B'. This state can actually be brought about by various causes, such as puckering of the work cloth, loss in the feed amount due to slippage between the work cloth and the feed dog, and the like. In general, the third distance L3 is shorter than the second distance L2 in most cases. In other words, cases in which the feed efficiency is less than 1 are more common than cases in which the feed efficiency is greater than 1.

In a case where the feed efficiency R is not 1 (NO at Step S17), the CPU 61, based on the feed efficiency R, corrects the remaining distance to the second position E2, which is the ending position, that is, the fourth distance H1 from the actual pause position B' to the second position E2 (Step S18). Specifically, the CPU 61 corrects the fourth distance H1 to as fifth distance H2 by multiplying the fourth distance H1 by 1/R, which is the inverse of the feed efficiency R and then sets a planned ending position E2'. As shown in FIG. 9, in a case where the feed efficiency R is less than 1, the fifth distance H2 is longer than the fourth distance H1.

The CPU 61, using the fifth distance H2 from the actual pause position B' to the planned ending position E2' as the planned feed distance, performs the sewing in accordance with the sewing data and stops the sewing at the planned ending position E2' (Step S19). For the sewing, the CPU 61 may use the sewing data that follow the data that have already been used for the sewing up to the planned pause position B at Step S11, and the CPU 61 may also use the same method that was used at the previously described Steps S8 and S11 to specify the sewing data for the sewing that covers the fifth distance H2 and then stops.

Note that, in order to stop the sewing accurately at the ending position, it is preferable for the CPU 61 to set the final sewing data based on the lengths of the individual stitches instead of on the lengths of the individual stitch patterns, using the same sort of processing as in the pause position setting processing (refer to FIG. 8). On the other hand, in order to stop the sewing at the delimiting position that is the closest to the ending position, instead of stopping the sewing in the middle of a stitch pattern, the CPU 61 may perform only the same sort of processing as in the pause position setting processing. Alternatively, the CPU may calculate the number of the selected stitch patterns that will fit within the fifth distance H2, and then correct the individual feed amount data items such that the target value for the feed distance that is indicated by the corresponding feed amount data becomes equal to the fifth distance H2.

As described previously, the fifth distance H2 has been corrected according to the teed efficiency R. Therefore, when the sewing is performed in accordance with the sewing data up to the planned ending position E2', the position where the sewing is actually stopped is not the planned ending position E2', but the second position E2, hi other words, the CPU 61 is able to end the sewing accurately at the ending position that the user has designated.

In contrast, in a case where the feed efficiency R is 1, that is, is 100% (YES at Step S17), the planned feed distance and the actual feed distance are equal. Accordingly, the second position E2 does not shift, even if the sewing is performed without correcting the fourth distance H1 from the actual pause position B' to the second position E2. Therefore, the CPU 61, using the second position E2 in its existing form as the planned ending position, performs the sewing over the fourth distance H1 in accordance with the unprocessed data among the sewing data that were stored in the RAM 63 at Step S1, and stops the sewing at the second position E2, which is the planned ending position (Step S20). Except for the fact that the distance to the planned ending position is different, the content of the processing at Step S20 is the same as at Step S19.

As explained above, the sewing machine 1 in the present embodiment first feeds the work cloth over the second distance L2, in accordance with the feed amount data for feeding the work cloth from the reference position S, where the sewing is started, to the planned pause position B. If puckering of the work cloth, loss in the feed amount, or the like occurs at this time, the feed efficiency of the feed mechanism 87 and the feed dog 35 drops below 100%. Consequently, the third distance L3, which is the actual feed distance, becomes shorter than the second distance L2. Therefore, if the work cloth is fed in accordance with the feed amount data for feeding the work cloth over the remaining fourth distance H1, the actual feed distance will not match the fourth distance H1, and the actual ending position of the sewing will not be the second position E2, which is the designated ending position.

Accordingly, the sewing machine 1 in the present embodiment corrects the remaining fourth distance H1 in accordance with the feed efficiency R that is calculated based on the second distance L2 and the third distance L3, then feeds the work cloth in accordance with the feed amount data for feeding the work cloth over the corrected fifth distance H2. Therefore, the sewing machine 1 is actually able to perform the sewing accurately on the work cloth over the remaining fourth distance H1, and is able to end the sewing at the second position E2, which is the designated ending position.

The user may cause the sewing machine 1 to identify the first position E1 by placing the pen tip 911 of the ultrasound pen 91 at the position on the work cloth where the user wants to end the sewing. Furthermore, after the sewing has been performed while the work cloth is fed over the second distance L2 by the sewing machine 1, the user may cause the sewing machine 1 to identify the second position E2 by once again placing the pen tip 911 of the ultrasound pen 91 at the same position on the work cloth where the pen tip 911 was placed before the work cloth was fed. The user is thus able to cause the sewing machine 1 to perform the previously described processing simply by operating the ultrasound pen 91. In particular, in the present embodiment, both before the first position E1 is designated and after the work cloth has been fed over the second distance L2, a message is displayed on the LCD 15 that prompts the user to designate the position where the sewing is to be ended with the ultrasound pen 91. Therefore, the sewing machine 1 can cause the user to recognize, at the appropriate time, that the ending position should be designated and can cause the ending position to be designated accurately.

In the present embodiment, the second distance L2 from the reference position S to the planned pause position B is the distance to the delimiting position of a stitch pattern that is closest to the position L. The distance L1 is the distance that is derived by multiplying the first distance T from the reference position S to the first position E1 by the coefficient q, which is less than 1. Accordingly, by setting the coefficient q appropriately in the sewing machine 1, it is possible to cause the sewing machine 1 to pause the sewing at the appropriate position between reference position S, which is the starting position of the sewing, and the first position E1 (the second position E2), which is the ending position of the sewing. Furthermore, because the sewing machine 1 pauses the sewing at a delimiting position of a stitch pattern, and not midway through the sewing of a stitch pattern, it is possible to maintain the stitch pattern in a good shape.

Various types of modifications can be made to the embodiment that is described above. For example, the sewing ending position adjustment processing in the embodiment may be used not only in the sewing machine 1 that is explained as an example in the embodiment, but also in other types of sewing machines that are configured to perform sewing while feeding a work cloth in a specified feed direction. For example, the sewing ending position adjustment processing may also be used in a multi-needle sewing, machine that has a plurality of sewing needles. The sewing ending position adjustment processing may also be used in an embroidery sewing machine on which an embroidery frame can be mounted and that is capable of performing sewing while the embroidery frame is moved in an X axis direction and a Y axis direction, in a case where the sewing is performed while the embroidery frame is moved in a fixed direction.

The CPU 61 does not necessarily have to use the coefficient q to calculate the distance L1. The CPU 61 may also calculate the distance L1 based an a value that the user has designated by a panel operation. The CPU 61 does not necessarily have to set the second distance L2 based on a delimiting position of a stitch pattern within the selected stitch pattern/patterns. The CPU 61 may also set the second distance L2 based on the delimiting position of the selected stitch pattern/patterns or on the delimiting position of a stitch within a stitch pattern. The CPU 61 does not necessarily have to use the coefficient q to calculate the second distance L2. For example, the user may also designate the number of the selected stitch patterns by a panel operation. If the total length of the designated number of the selected stitch patterns is less than the first distance T, the total length of the designated number of the selected, stitch patterns may be used as the second distance L2.

In the stitch pattern length calculation processing (refer to FIG. 7) in the embodiment, an example is explained in which the length of each individual stitch pattern in the feed direction is calculated based on the sewing data for the individual stitch pattern. However, the length of each individual stitch pattern in the feed direction may also be stored in advance in one of the ROM 62 and the flash ROM 64 in association with the sewing data.

The information that prompts the user to designate the ending position does not have to be a message that is displayed on the LCD 15. For example, the sewing machine 1 may also be provided with a speaker, and the CPU 61 may provide the information by outputting an audio message from the speaker. The sewing machine 1 may also be provided, with an LED lamp, and the CPU 61 may provide the information by flashing the LED lamp. The providing of the information that prompts the user to designate the ending position does not necessarily have to be performed.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a feed portion that is configured to feed a work cloth in a feed direction;

a detection portion that is configured to detect ultrasonic waves;

a processor; and a memory that is configured to store computer-readable instructions that, when executed by the processor, cause the processor to perform processes comprising:

identifying a position of an ultrasonic wave transmission source as a first position, based on the ultrasonic waves that have been transmitted from the ultrasonic wave transmission source and detected by the detection portion, the ultrasonic wave transmission source being placed on the work cloth, calculating a first distance based on the first position, the first distance being a distance from a reference position to the first position, causing the feed portion to feed the work cloth in accordance with first data, the first data being data for feeding the work cloth over a second distance, the second distance being shorter than the first distance, identifying, after the feed portion has fed the work cloth in accordance with the first data, a position of the ultrasonic wave transmission source as a second position, based on the ultrasonic waves that have been transmitted from the ultrasonic wave transmission source and detected by the detection portion, the ultrasonic wave transmission source being placed on the work cloth, the second position being an equivalent of the first position after the work cloth has been fed, calculating a third distance based on the first distance and the second position, the third distance being an actual distance over which the work cloth has been fed, calculating a feed efficiency of the teed portion, based on the second distance and the third distance, the second distance being a distance had on the first data, correcting a fourth distance to a fifth distance, based on the feed efficiency, the fourth distance being a distance that is derived by subtracting the third distance from the first distance, and causing the feed portion to feed the work cloth in accordance with second data, the second data being data for feeding the work cloth over the fifth distance.

2. The sewing machine according to claim 1, wherein the computer-readable instructions further cause the processor to perform processes comprising:

identifying a length of a selected stitch pattern in the feed direction, based on sewing data for forming stitches of the stitch pattern in the work cloth, and setting a length of one or more iterations of the stitch pattern as the second distance, based on the first distance and the length of the stitch pattern in the feed direction, the length of one or more iterations of the stitch pattern being shorter than the first distance.

3. The sewing machine according to claim 2, wherein the setting of the second distance includes setting, as the second distance, the length of one or more iterations of the stitch pattern that is closest to a distance that is derived by multiplying the first distance by a coefficient, the coefficient being less than one.

4. The sewing machine according to claim 1, further comprising:

a notification portion that is configured to provide information, wherein the computer-readable instructions further cause the processor to perform processes comprising:

causing the notification portion to provide information that prompts a user to place the ultrasonic wave transmission source on the work cloth in a planned sewing ending position, in order to cause the processor to identify the first position, and causing the notification portion to provide information that prompts the user to place the ultrasonic wave transmission source in the planned sewing ending position, in order to cause the processor to identify the second position, after the feed portion has fed the work cloth in accordance with the first data.

* * * * *